US009543135B2

(12) United States Patent
Kumano et al.

(10) Patent No.: US 9,543,135 B2
(45) Date of Patent: Jan. 10, 2017

(54) MASS SPECTROMETER AND MASS ANALYZING METHOD FOR EFFICIENTLY IONIZING A SAMPLE WITH LESS CARRY-OVER

(75) Inventors: Shun Kumano, Kokubunji (JP); Masuyuki Sugiyama, Hino (JP); Yuichiro Hashimoto, Tachikawa (JP); Hideki Hasegawa, Tachikawa (JP); Masuyoshi Yamada, Ichikawa (JP); Kazushige Nishimura, Kokubunji (JP); Hidetoshi Morokuma, Hitachinaka (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 13/562,435

(22) Filed: Jul. 31, 2012

(65) Prior Publication Data

US 2013/0048851 A1 Feb. 28, 2013

(30) Foreign Application Priority Data

Aug. 26, 2011 (JP) ..... 2011-184266

(51) Int. Cl.
*H01J 49/00* (2006.01)
*H01J 49/04* (2006.01)

(52) U.S. Cl.
CPC ..... *H01J 49/0431* (2013.01)

(58) Field of Classification Search
CPC ..... H01J 49/00
USPC ..... 250/281, 282, 283, 286, 288, 289
See application file for complete search history.

(56) References Cited

U.S. PATENT DOCUMENTS 4,008,388 A * 2/1977 McLafferty et al. ..... 702/27
4,298,795 A * 11/1981 Takeuchi ..... H01J 49/0468 250/282
4,551,624 A * 11/1985 Spangler et al. ..... 250/287
5,055,677 A 10/1991 Amirav et al.
5,175,431 A * 12/1992 Eisele et al. ..... 250/288
5,184,016 A * 2/1993 Ronan et al. ..... 250/288
5,191,211 A * 3/1993 Gorman, Jr. ..... 250/282
5,308,977 A * 5/1994 Oishi et al. ..... 250/288
5,345,145 A * 9/1994 Harafuji et al. ..... 315/111.41
5,426,300 A * 6/1995 Voss ..... H01J 49/24 250/288
5,457,316 A * 10/1995 Cohen et al. ..... 250/286
5,477,048 A * 12/1995 Nakagawa et al. ..... 250/288
5,869,344 A * 2/1999 Linforth et al. ..... 436/173

(Continued)

FOREIGN PATENT DOCUMENTS

CN 101937822 A 1/2011
EP 0 292 974 A2 11/1988

(Continued)

OTHER PUBLICATIONS

The Venturi Effect, Copyright 2013, Tech-Faq, http://www.tech-faq.com/venturi-effect.html.*

(Continued)

*Primary Examiner* — Jason McCormack
(74) *Attorney, Agent, or Firm* — Baker Botts L.L.P.

(57) ABSTRACT

A mass spectrometer for efficiently ionizing a sample with less carry-over. The ratio of the amount of sample gas to that of a whole headspace gas is increased by decreasing the pressure inside of a sample vessel in which the sample is sealed thereby efficiently ionizing the sample.

11 Claims, 10 Drawing Sheets

(56) References Cited

U.S. PATENT DOCUMENTS

| | | | | |
|---|---|---|---|---|
| 5,896,196 | A * | 4/1999 | Pinnaduwage | 356/311 |
| 5,917,185 | A * | 6/1999 | Yeung | H01J 49/0404 250/288 |
| 6,207,954 | B1 * | 3/2001 | Andrien et al. | 250/288 |
| 6,257,835 | B1 * | 7/2001 | Kaehler | 417/205 |
| 6,265,717 | B1 * | 7/2001 | Sakata et al. | 250/289 |
| 6,454,862 | B1 | 9/2002 | Yoshida et al. | |
| 6,483,108 | B1 * | 11/2002 | Sakairi | H01J 49/168 250/288 |
| 6,492,639 | B1 * | 12/2002 | Horner et al. | 250/282 |
| 6,809,314 | B2 * | 10/2004 | Yamada | G01N 15/0266 209/143 |
| 2002/0020812 | A1 * | 2/2002 | Vestal | H01J 49/164 250/287 |
| 2002/0125423 | A1 * | 9/2002 | Ebeling | H01J 49/044 250/288 |
| 2002/0166958 | A1 * | 11/2002 | Afeyan et al. | 250/282 |
| 2003/0025074 | A1 * | 2/2003 | Li | H01J 49/107 250/288 |
| 2006/0096359 | A1 | 5/2006 | Nath et al. | |
| 2007/0023679 | A1 * | 2/2007 | Reilly | H01J 49/0031 250/426 |
| 2007/0089483 | A1 | 4/2007 | Kriel | |
| 2009/0095902 | A1 | 4/2009 | Robinson et al. | |
| 2011/0042560 | A1 * | 2/2011 | Ouyang | H01J 49/105 250/282 |
| 2011/0114210 | A1 | 5/2011 | Zhang et al. | |

FOREIGN PATENT DOCUMENTS

| | | |
|---|---|---|
| EP | 2254142 A2 | 11/2010 |
| JP | 2011-027557 | 2/2011 |
| WO | WO 2007/042746 | 4/2007 |
| WO | WO 2012/177884 | 12/2012 |

OTHER PUBLICATIONS

Nicholas H. Snow, Head-space analysis in modern gas chromatography, Trends in Analytical Chemistry, 2002, pp. 608-617, vol. 21, No. 9.

Darrouzès et al., "New approach of solid-phase microextraction improving the extraction yield of butyl and phenyltin compounds by combining the effects of pressure and type of agitation", Journal of Chromatography A, 1072 (2005), pp. 19-27.

Psillakis, et al., "Vacuum-assisted headspace solid phase microextraction: Improved extraction of semivolatiles by non-equilibrium headspace sampling under reduced pressure conditions", Analytica Chimica Acta, vol. 742, 2012, pp. 30-36.

Extended European Search Report issued in European Patent Application No. 12178705.5 on Apr. 22, 2013.

N. P. Brunton et al., "The effects of temperature and pressure on the performance of Carboxen/PDMS fibres during solid phase microextraction (SPME) of headspace volatiles from cooked and raw turkey breast," Zhongguo Yaoshi—China Pharmacist, Yaowu Liuxingbingxue Zazhishe, Hubei, CN, vol. 16, No. 4, Jul. 1, 2001, pp. 294-302, XP002402467, ISSN: 1008-049X.

Communication pursuant to Article 94(3) EPC, dated May 29, 2015, which issued during the prosecution of European Patent Application No. 12 178 705.5, which corresponds to the present application.

Communication pursuant to Article 94(3) EPC, dated Jan. 27, 2016, which issued during the prosecution of European Patent Application No. 12 178 705.5, which corresponds to the present application.

* cited by examiner

MASS SPECTROMETER AND MASS ANALYZING METHOD FOR EFFICIENTLY IONIZING A SAMPLE WITH LESS CARRY-OVER

CLAIM OF PRIORITY

The present application claims priority from Japanese patent application JP 2011-184266 filed on Aug. 26, 2011, the content of which is hereby incorporated by reference into this application.

FIELD OF THE INVENTION

The present invention concerns a mass spectrometer and an operation method thereof

BACKGROUND OF THE INVENTION

Apparatus capable of measuring trace substances in mixed samples in situ, conveniently and at a high sensitivity for measurement of contamination in soils and atmospheric air, inspection of residual agricultural chemicals in foods, diagnosis by circulating metabolites, urine drug screening, etc. Mass spectrometry is used as one of methods capable of measuring trace substances at high sensitivity.

A mass spectrometer ionizes substances in a gas phase by an ionization source, introduce ions into a vacuumed part, and subject them to mass analysis. For increasing the sensitivity of the mass spectrometer, improvement in a sample introduction part for efficient transportation of a sample to the ionization source is important in addition to the improvement of an ionization source, a mass analyzer, a detector, etc.

As a method of introducing a sample in a gas state into a gas chromatograph or amass spectrometer, a headspace method is used generally. The headspace method includes a static headspace method and a dynamic headspace method (refer to TrAC Trends in Analytical Chemistry, 21 (2002) 608-617).

The static headspace method is a method of injecting and tightly sealing a sample in a vial or the like while leaving a predetermined space, leaving the sample at a constant temperature till gas-liquid equilibrium is attained, and then sampling a gas present in a gas phase, that is, a headspace gas by a syringe and analyzing the same. This is a method capable of determining the quantity of a volatile substance present in a trace amount in a sample solution with less effect of a solvent in the sample solution. The concentration of the sample gas in the headspace gas can be increased, for example, by a method of overheating the sample solution to a high temperature, or by adding a salt to a sample solution thereby promoting vaporization by a salting-out effect.

The dynamic headspace method is a method of introducing an inert gas such as helium or nitrogen to a vial in which the sample has been injected and driving out the sample gas. The inert gas is introduced into the gas phase in the vial, or introduced into a liquid phase to purge the sample. When the gas is introduced into the liquid phase, since bubbles are generated, the surface area at the gas/liquid boundary is increased to further promote evaporation.

Both in the static headspace method and the dynamic headspace method, a method of concentrating the headspace gas by collection on an absorbent is also proposed.

A method of efficiently extracting a gas from a headspace part in a vial bottle has also been proposed (U.S. Pat. No. 5,869,344). In this method, a headspace gas is sucked by decreasing the pressure at the end of a pipeline on the side of an ionization source for connecting a vial bottle and an ionization source by the Venturi effect and then the gas is ionized by atmospheric pressure chemical ionization.

For promoting the evaporation of a sample, a device of dispersing a sample solution into micro droplets has also been proposed (Japanese Unexamined Patent Publication No. 2011-27557).

SUMMARY OF THE INVENTION

Existent headspace methods described not only in "TrAC trends in Analytical Chemistry", but also the special headspace methods described in U.S. Pat. No. 5,869,344 and JP-A 20011-20557 involve problems that the density of the sample gas in the headspace gas depends on the saturated vapor pressure of the sample. Even when a sample solution is placed in a vial bottle and left for a long time or an inert gas is introduced, the amount of the sample gas in the headspace gas cannot be increased to more than an amount at a saturation vapor pressure. The saturation vapor pressure of water is about 3,000 Pa at 25° C. In the headspace methods described above, the pressure in the headspace part is increased to about the atmospheric pressure or higher. In view of the partial pressure ratio at an atmospheric pressure, for example, of about 100,000 Pa, the existent amount of water molecules in the gas is about 3%. While the saturated vapor pressure of water and sample molecules can be increased when the solution is heated, this results in a problem of requiring electric power for heating, condensation of the heated gas on cold spots of a pipeline, etc.

While the sample can be concentrated by capturing the sample gas using an adsorbent, this complicates operations such as requirement of a process for desorbing the sample again from the adsorbent, and the throughput is also poor.

According to the invention, the density of a sample in a headspace gas is increased by decreasing the pressure inside of a sample vessel that contains the sample, thereby ionizing the sample efficiently.

The mass spectrometer, as one aspect of the present invention, comprises a sample vessel in which a sample is sealed, an ionization housing connected to the sample vessel and having an ionization source for taking in the sample gas present in the sample vessel and ionizing the same, in which the pressure is lower than the pressure inside of the sample vessel, a vacuum chamber (or vacuumed chamber) connected to the ionization housing and having amass analyzer for analyzing the ionized sample, and means for decreasing the pressure inside of the sample vessel.

The mass analyzing method, as another aspect of the present invention, uses a sample vessel in which a sample is sealed, an ionization source connected to the sample vessel for taking in the sample and ionizing the same, and a vacuum chamber connected to the ionization housing and having amass analyzer for analyzing the ionized sample, and includes the steps of decreasing the pressure inside of the vacuum chamber, decreasing the pressure inside of the sample vessel, taking in a sample gas present in the sample vessel into the ionization housing and ionizing the gas, and analyzing the ionized sample in the mass analyzer.

The present invention can provide amass spectrometer and a mass analyzing method capable of efficiently ionizing a sample with less carry-over.

BRIEF DESCRIPTION OF THE DRAWINGS

FIG. 2 shows configurational view of discharge electrodes according to the first embodiment, in which

FIG. 8 shows a mass spectrograph in which

DETAILED DESCRIPTION OF THE PREFERRED EMBODIMENTS

First Embodiment

Figure 1:
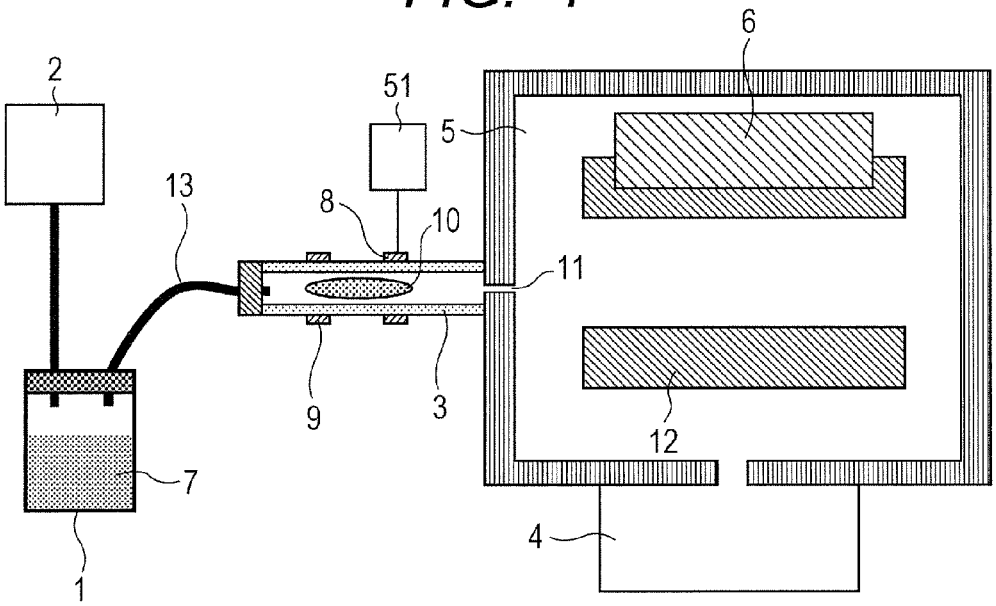
FIG. 1 shows a configurational view for a device according to a first embodiment.

FIG. 1 is a configurational view showing an embodiment of a mass spectrometer according to the invention. The mass spectrometer mainly includes a vial bottle 1 for containing a sample 7, a pump 2 for decreasing the pressure inside of the vial bottle 1 and, in addition, an ionization housing 3 formed of a dielectric substance such as glass, plastic, ceramic, resin, or the like, and a vacuum chamber 5 kept at a pressure of 0.1 Pa or lower by a vacuum pump 4. A typical ionization housing is a tube having an outer diameter of about 4 mm and an inner diameter of about 1 to 4 mm. While the vial bottle 1 and the ionization housing 3 are connected by way of a sample transfer line in FIG. 1, they may be also connected not by the sample transfer line but by way of an orifice so long as the pressure condition as to be described later can be maintained.

The sample 7 may be liquid or solid. The pressure inside of the vial bottle 1 is decreased by the pump 2. The pressure inside the vacuum chamber is kept at 0.1 Pa or lower, and the pressure in the ionization housing 3 is determined by the exhaust velocity of the pump 4, conductance of an orifice 11, conductance of a tube 13 connecting the vial bottle 1 and the ionization housing 3. However, the pressure in the ionization housing 3 is lower than the pressure in the vial bottle 1, and the headspace gas flows from the vial bottle 1 into the ionization housing 3. As the pressure in the ionization housing 3 approaches the pressure in the vacuum chamber 5, loss of the ions upon introduction from the ionization housing 3 into the vacuum chamber 5 is decreased further. Accordingly, the sensitivity of the device is improved more when a sample is ionized under a reduced pressure than when the sample is ionized under an atmospheric pressure. In this embodiment, a plasma 10 is generated by barrier discharge in the ionization housing 3. Sample molecules are ionized by way of reaction between charged molecules generated by the plasma 10 and water molecules. A pressure range where the plasma 10 is generated stably is present and a typical value is 100 to 5,000 Pa. Further, a pressure range capable of efficiently ionizing the sample is from 500 to 3,000 Pa. If the pressure is lower than the lower limit, ion fragmentation is increased. Further, at a pressure of 1 Pa or lower, the plasma 10 is not generated. Also at a pressure of 3,000 Pa or higher, the plasma 10 is less generated and the ionization efficiency is lowered.

Since the saturated vapor pressure of a sample does not depend on the ambient pressure, a partial pressure ratio of the sample increases more as the pressure inside of the vial bottle 1 decreases. For example, the vapor pressure of the sample is assumed as constant at 10 Pa. When the inner pressure of the vial bottle 1 is at an atmospheric pressure of 100,000 Pa, the ratio of the sample occupying the headspace gas is 0.01%. When the inner pressure of the vial bottle 1 is decreased to 50,000 Pa, the ratio of the sample is 0.02% and when it is decreased to a 5,000 Pa, the ratio is 0.2%. As described above, when the inner pressure in the vial bottle 1 is decreased to 1/20, the ratio of the sample gas in the headspace gas is increased theoretically to 20 times. Assuming the pressure in the ionization housing 3 and the pressure in the vacuum chamber 5 are constant, the flow rate of the headspace gas introduced into the vacuum chamber 5 does not change irrespective of the inner pressure in the vial bottle 1. Accordingly, increase of the ratio of the sample gas in the headspace gas along with decrease of the inner pressure in the vial bottle as described above means increase in the amount of the sample gas introduced into the vacuum chamber 5 and the sensitivity of the device is increased.

When the pressure inside of the vial bottle is decreased as: 50,000, 30,000 and 10,000 Pa, the amount of the sample gas to be introduced into the vacuum chamber 5 increase as about twice, 3.5 times, and 10 times, and the peak intensity of the mass spectrum measured for the sample at an identical concentration is increased. However, as the degree of depressurization increases, sealing performance demanded for the vial bottle 1 becomes severer. This increases the cost of the vial bottle 1. In addition, it is necessary to connect a pump of a large displacement for depressurization at high degree, which results increase in the cost and increase in the weight. The device has to be designed while considering the balance between the problems described above and the improvement in the sensitivity.

Further, an evaporation velocity is in proportion to a diffusion velocity of a gas and the diffusion velocity of the gas is in inverse proportion to a pressure. Accordingly, as the pressure decreases, the evaporation velocity increases and the time till a sample reaches a saturated vapor pressure is shortened. However, when the sample is liquid, since it causes explosive boiling, the pressure of the headspace part cannot be decreased to lower than the saturated vapor pressure of the liquid.

When a first discharge electrode 8 and a second discharge electrode 9 are disposed in the ionization housing and a voltage is applied therebetween, dielectric barrier discharge is generated to form a plasma 10. The plasma 10 generates charged particles, water cluster ions are generated based thereon, and the sample 7 is ionized by the ion molecule interaction between the water cluster ions and the sample gas. The method of the invention provides soft ionization utilizing discharge plasma with less fragmentation of the sample ions, when compared with electron impact ionization that causes much fragmentation. When it is intended to positively cause fragmentation, an electric power applied to the discharge electrodes may be increased as to be describer later. The sample ions generated by the discharge plasma 10 are introduced through an orifice 11 into the vacuum chamber 5. A mass analyzer 12 and a detector 6 are disposed in the vacuum chamber 5. The introduced ions are separated on every m/z ratio in the mass analyzer 12 such as a quadrupole mass filter, an ion trap, a time-of-flight mass spectrometer, etc. and detected by the detector 6 such as an electron multiplier.

A typical distance between the first discharge electrode 8 and the second discharge electrode 9 is about 5 mm and as the distance between the discharge electrodes is longer, higher electric power is necessary for discharge. For example, an AC voltage is applied to one of the discharge electrodes, and a DC voltage is applied to the other of the discharge electrodes from the power source 51. The AC voltage to the applied may be in a rectangular waveform or a sinusoidal waveform. In a typical example, the applied voltage is about 0.5 to 10 kV and the applied frequency is about 1 to 100 kHz. For an identical voltage amplitude, the density of the plasma 10 increases more by using the rectangular wave. On the other hand, in a case of using the sinusoidal wave, since the voltage can be stepped-up by coils when the frequency is high, this provides a merit of decreasing the cost of the power source 51 than that in a case of using the rectangular waveform. Since the charged power increases more as the voltage and the frequency are higher, the density of the plasma 10 tends to be higher. However, when the charged power is excessively high, the plasma temperature is increased tending to cause fragmentation. The frequency and the amplitude of the AC voltage may be changed on every samples or ions as the target for measurement. For example, the charged power is increased in a case of measuring molecules that undergo less fragmentation such as inorganic ions and in a case of intentionally causing fragmentation to target ions. On the other hand, the charged power is decreased in a case of measuring molecules liable to undergo fragmentation. Further, when the power source is switched so as to apply the voltage to discharge electrodes only when it is necessary, the consumption power of the power source 51 can be decreased.

Figure 2A:
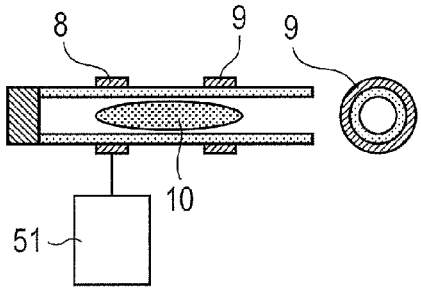
FIG. 2A shows an example of using two cylindrical electrodes.
Figure 2B:
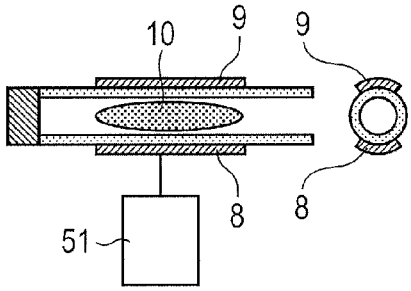
FIG. 2B shows an example of using plate-like electrodes.
Figure 2C:
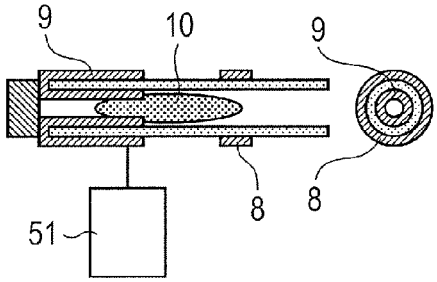
FIG. 2C shows an example where one of the electrodes is present in a dielectric substance.

The arrangement of the discharge electrodes can be changed variously so long as discharge is caused byway of the dielectric substance. FIG. 2 shows a cylindrical having as a side elevational cross sectional view and a diametrical cross sectional view. FIG. 2A shows an arrangement of the discharge electrodes shown in FIG. 1 in which two cylindrical electrodes are used. Electrodes of a planar shape may also be used as shown in FIG. 2B. One of the electrodes may be inserted in the dielectric substance as shown in FIG. 2C. The number of the electrodes is not restricted to two but it may be increased to three, four, etc.

In the dielectric barrier discharge, the sample is ionized by the ion molecule reaction with the water cluster ions. Accordingly, increase in the water cluster ions leads to increase in the sample ions. It is assumed a case where the sample is in the form of an aqueous solution. The saturation vapor pressure of water at 25° C. is about 3,000 Pa. Usually, atmospheric air comprises about 80% nitrogen. However, when the pressure inside of the vial bottle 1 is decreased, for example, to 5,000 Pa, water molecules occupy about 60% in the headspace part. By the increase in the ratio of water molecules, the generation amount of the water cluster ions in the ionization housing 3 increases, which improves the ionization efficiency of the sample.

Sample carry-over is a problem always present in the mass spectroscopy by using the headspace method. If a pipeline (that is sample transfer line) is cleaned or exchanged on every exchange of the sample, the throughput is worsened. By decreasing the pressure inside of the vial bottle 1, the conductance of the sample transfer line necessary for maintaining the pressure at an optimal value in the ionization housing 3 or the vacuum chamber 5 can be increased and the inner diameter of the sample transfer line can be enlarged. This can decrease desorption of the sample to suppress carry-over. As described above, the evaporation speed is increased by depressurization. This means that molecules adsorbed to the sample transfer line are removed rapidly to decrease the carry-over.

Figure 3:
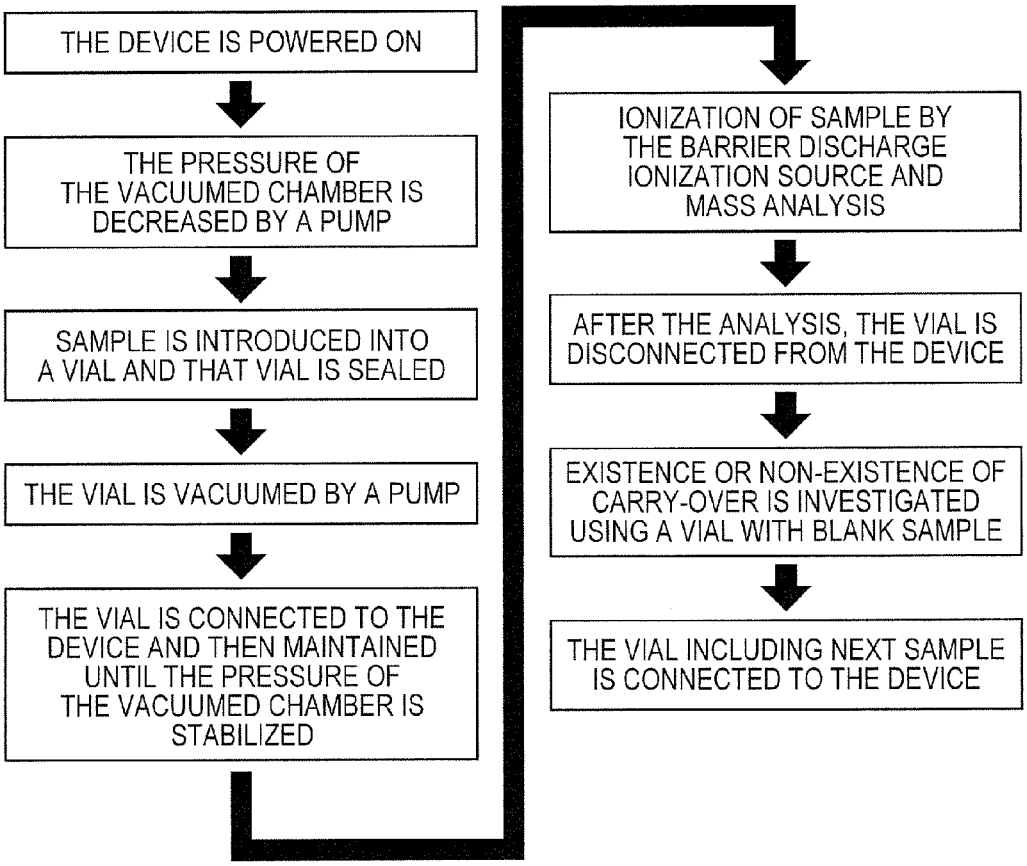
FIG. 3 shows a flow of a measurement in the first embodiment.

FIG. 3 shows a typical work flow of measurement. At first, the device is powered on and then the pressure inside of the vacuum chamber is decreased by a pump. In this stage, the ionization housing is connected to the outside at an atmospheric pressure. The sample is placed in the vial bottle and tightly sealed. It is preferred that the vial bottle is set to the device after decreasing the pressure by the pump. When the depressurized (or vacuumed) vial bottle is set, the pressure of the ionization housing 3 and the vacuum chamber 5 is further decreased. As described above, it is necessary that the pressure in the vacuum chamber is set to 0.1 Pa or lower and the pressure in the ionization housing 3 is set to 500 to 3,000 Pa, and it is necessary to design the vacuum system such that the pressures described above are attained in the state of setting the depressurized vial bottle 1. After setting the vial bottle 1, the power source of the barrier discharge is turned on to perform ionization and mass spectroscopy of the sample. After measurement, the vial bottle 1 with the sample contained therein is removed, and a vial bottle 1 with a blank sample is set so as to confirm non-existence of carry-over. If there is no carry-over, the process goes to the measurement for the next sample. If carry-over is present, cleaning of the ionization housing 3 is necessary.

Figure 5:
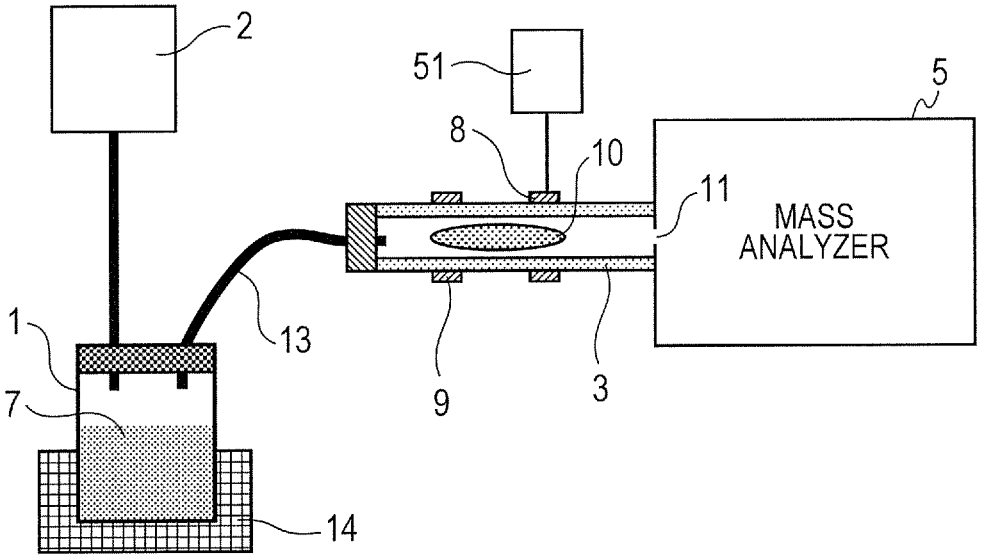
FIG. 5 shows a configurational view for a device of the first embodiment.

When the vapor pressure of the sample is excessively low at a room temperature, the vial bottle 1 is heated by attaching a heater 14 as shown in FIG. 5 to increase the vapor pressure. In this case, the lower limit for the inner pressure of the vial bottle 1 that can be decreased is increased compared with the case of not applying heating. For example, when the vial bottle 1 is heated up to 60° C., since the saturation vapor pressure of water is about 20,000 Pa, the pressure of the vial bottle cannot be decreased to 20,000 Pa or lower.

Figure 4:
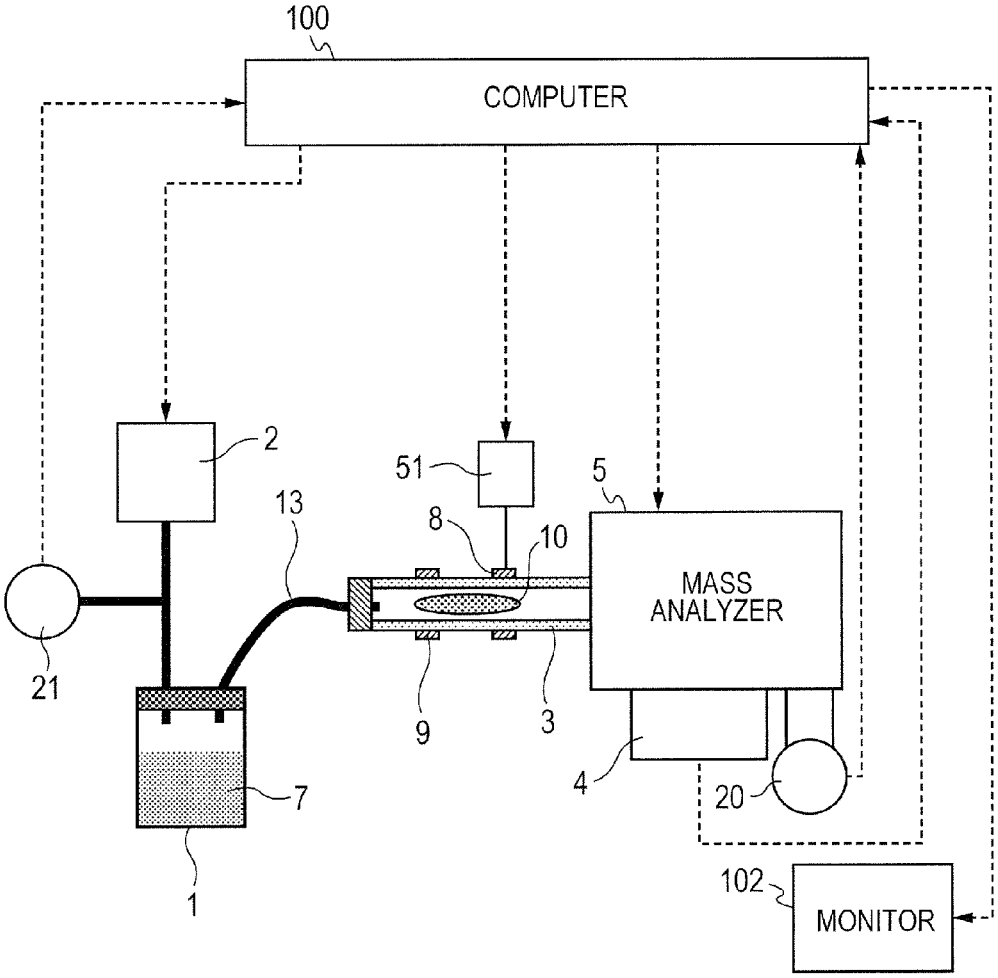
FIG. 4 shows a configurational view for the system of the first embodiment.

FIG. 4 is a configurational view for the system of a device. The system is controlled by a computer 100. The pressure is controlled by pumps 2 and 4 while measuring the pressure by pressure gages 20 and 21 attached to the vial bottle and the vacuum chamber. In accordance with the flow of measurement shown in FIG. 3, operation procedures are outputted to a monitor screen 102. After setting a vial bottle 1 to the device, an ionization source is powered to start ionization and measurement. The result of the spectroscopy is inputted into the computer 100, and necessary result of analysis is outputted to the monitor screen 102.

Second Embodiment

Figure 6:
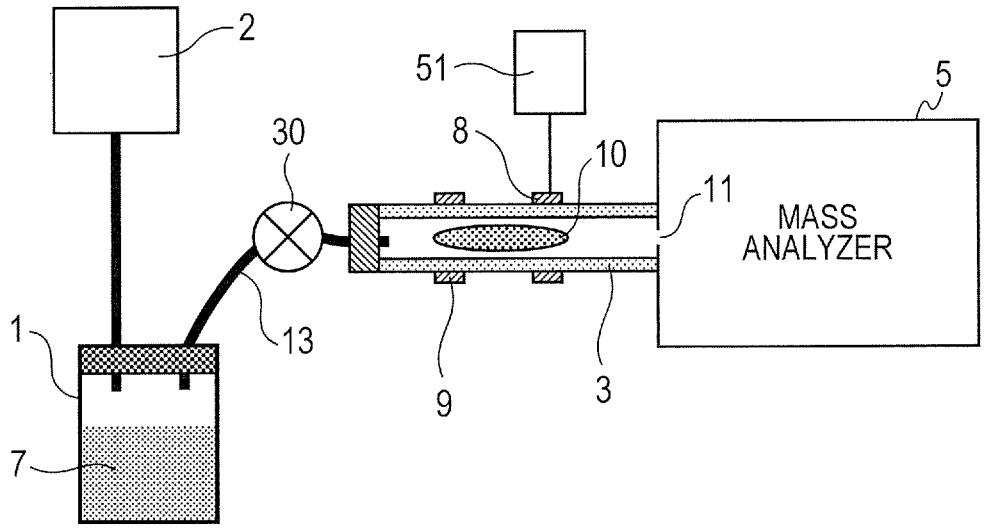
FIG. 6 shows a configurational view for a device of a second embodiment.

FIG. 6 is a configurational view showing an embodiment of a mass spectrometer according to the invention. The pressure condition for a plasma 10 and the output voltage from a power source 51 are identical with those of the first embodiment. Different from the first embodiment, a pulse valve 30 is interposed between an ionization housing 3 and a vial bottle 1, and a gas is introduced discontinuously into the ionization housing 3. Upon introduction of the gas, the pressure in the ionization housing 3 increases temporality, and the pressure in the ionization housing 3 is lowered when the pulse valve 30 is closed. Accordingly, compared with the continuous gas introduction system of the first embodiment, even when the inner diameter of the orifice 11 is increased to increase the flow rate of the gas introduced into the vacuum chamber 5, the pressure in the vacuum chamber 5 can be maintained to 0.1 Pa or lower after closing the pulse valve 30. Since the headspace gas does not flow to the ionization housing 3 during closure of the pulse valve 30, time of the gas staying in the ionization housing 3 is shortened to decrease adsorption of the gas. Assuming that the gas introduction amount to and the vacuum chamber 5 is identical with that in the continuous introduction system, a small-sized pump of lower evacuation speed can be used. The pressure in the ionization source and the pressure in the vacuum chamber can be controlled by the conductance of the sample transfer line and the opening time of the valve. Further, by opening the pulse 30 again in a state of trapping the ions in the mass analyzer 12, the inner pressure of the vacuum chamber 5 can be increased to a pressure where collision induced dissociation is generated efficiently. That is, since the pulse valve 30 is present, pressure in the vacuum chamber 5 can be controlled simply and conveniently. However, compared with the first embodiment, since the pressure in the vacuum chamber 5 is increased by the on-off of the valve even when it is done temporary, load is applied on the pump, and the frequency of exchanging pump 4 is increased. Further, a circuit and a power source for controlling the pulse valve 30 are necessary and the configurational complicated compared with the first embodiment.

The flow of measurement is substantially identical with that of the first embodiment. After setting the depressurized vial bottle 1 to the device, the device for the barrier discharge is powered on and the pulse valve 30 is opened and closed thereby introducing a headspace gas into the ionization housing.

Figure 8A:
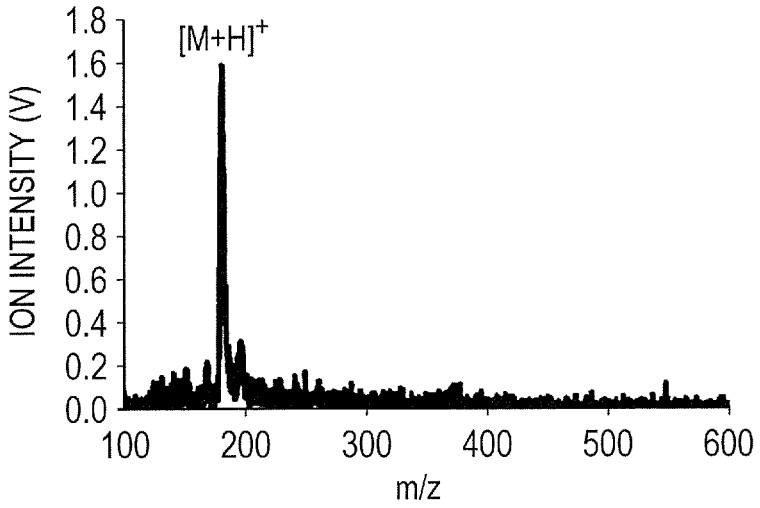
FIG. 8A shows a result when the pressure in a vial bottle is decreased.
Figure 8B:
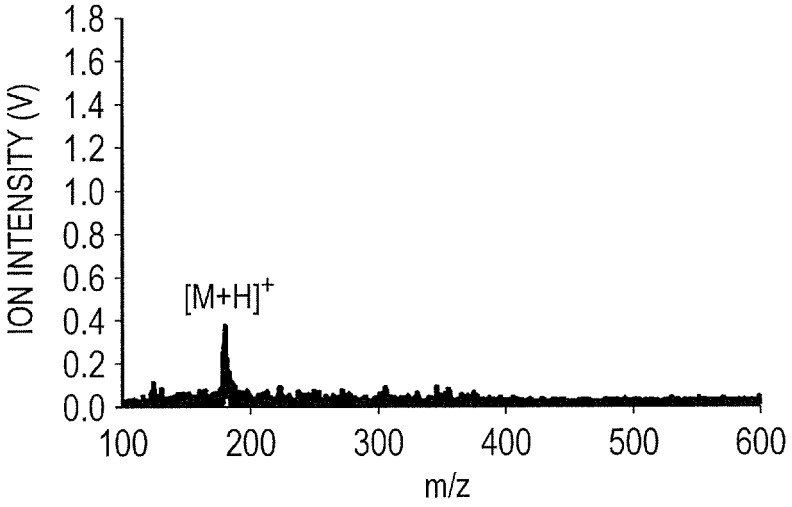
FIG. 8B shows a result when the pressure in the vial bottle is not decreased.

FIG. 8 shows a result of dissolving methoxyphenamine (MP) at 1 ppm concentration in a 60% $K_2CO_3$ aqueous solution and measuring the same. FIG. 8A shows the result when the pressure inside of the vial bottle was decreased to about 25,000 Pa and FIG. 8B shows the result when pressure inside of the vial bottle is not decreased. While $[M+H]^+$ could be confirmed at a position for m/z 180 in both of the cases, the peak density was as high as about 4 times in the case of decreasing the pressure inside of the vial bottle.

Figure 7:
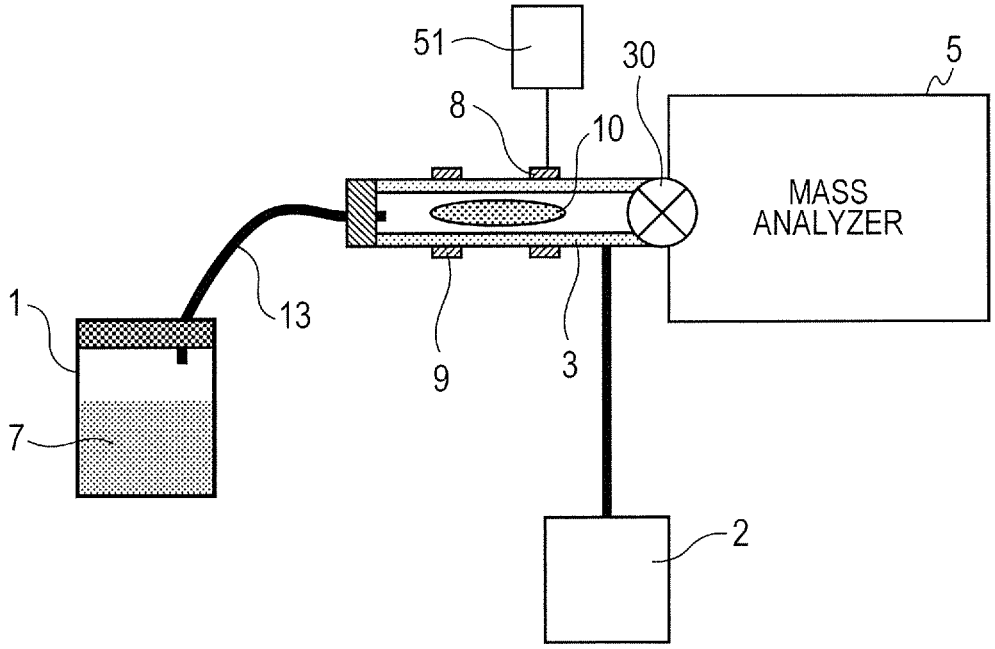
FIG. 7 shows a configurational view for the device of second embodiment.

As shown in FIG. 7, it is also possible to connect a pump 2 to an ionization housing 3 and interpose a pulse valve 30 between the ionization housing 3 and a vacuum chamber 5. In this case, during a state in which the pulse valve 30 is closed, the headspace gas always flows from a vial bottle 1 to the ionization housing 3. When the pulse valve 30 is opened, the sample is ionized and the formed ions are introduced into the vacuum chamber 5. A tube 13 may be removed and the vial bottle 1 and the ionization housing 3 may be connected directly.

The heater 14 for heating the vial bottle 1 shown in the first embodiment is applicable also in this embodiment.

Third Embodiment

Figure 9:
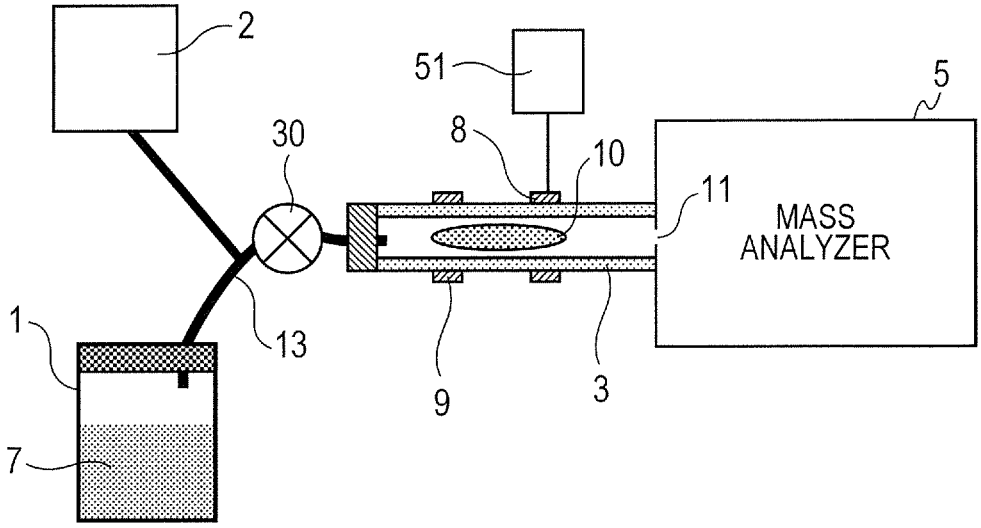
FIG. 9 shows a configurational view for a device of a third embodiment.

FIG. 9 is a configurational view showing an embodiment of the mass spectrometer according to the invention. The pressure condition for a plasma 10 and the output voltage of a power source 51 are identical with those of the first embodiment. Different from the first and second embodiments, a pump 2 for the vial bottle is connected not to the vial bottle 1 but to the tube 13. In the same manner as in the first and second embodiments, the pressure inside of vial bottle 1 is decreased and the ratio of the sample in the headspace gas is increased. Since the number of the sample transfer lines connected to the vial bottle 1 is decreased to one, the configuration of the vial bottle 1 is simplified and decrease in the cost is expected. On the other hand, since a fresh gas always flows continuously in the tube 13, it has a drawback that adsorption becomes remarkable The heater 14 for heating the vial bottle 1 shown in the first embodiment is applicable also in this embodiment.

Fourth Embodiment

Figure 10:
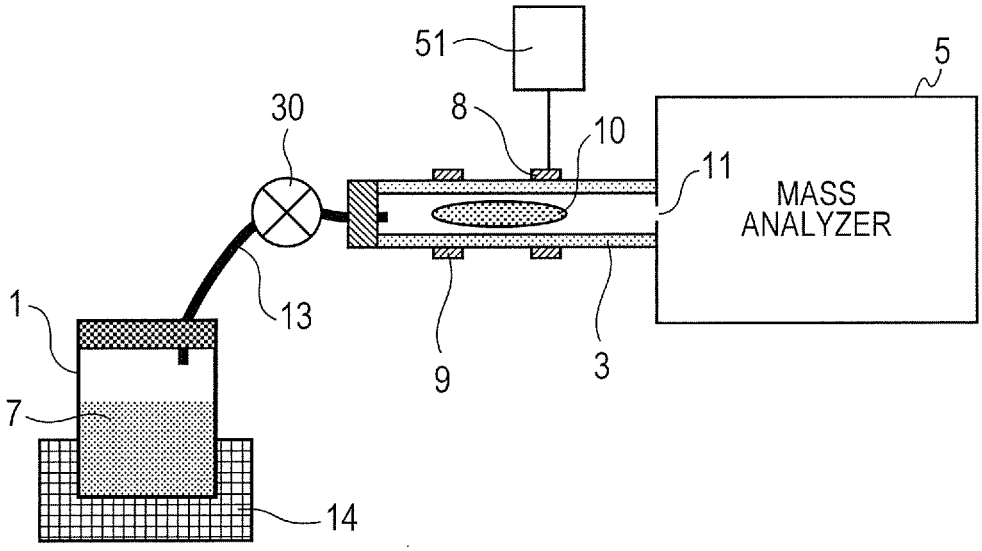
FIG. 10 shows a configurational view for a device of a fourth embodiment.
Figure 11:
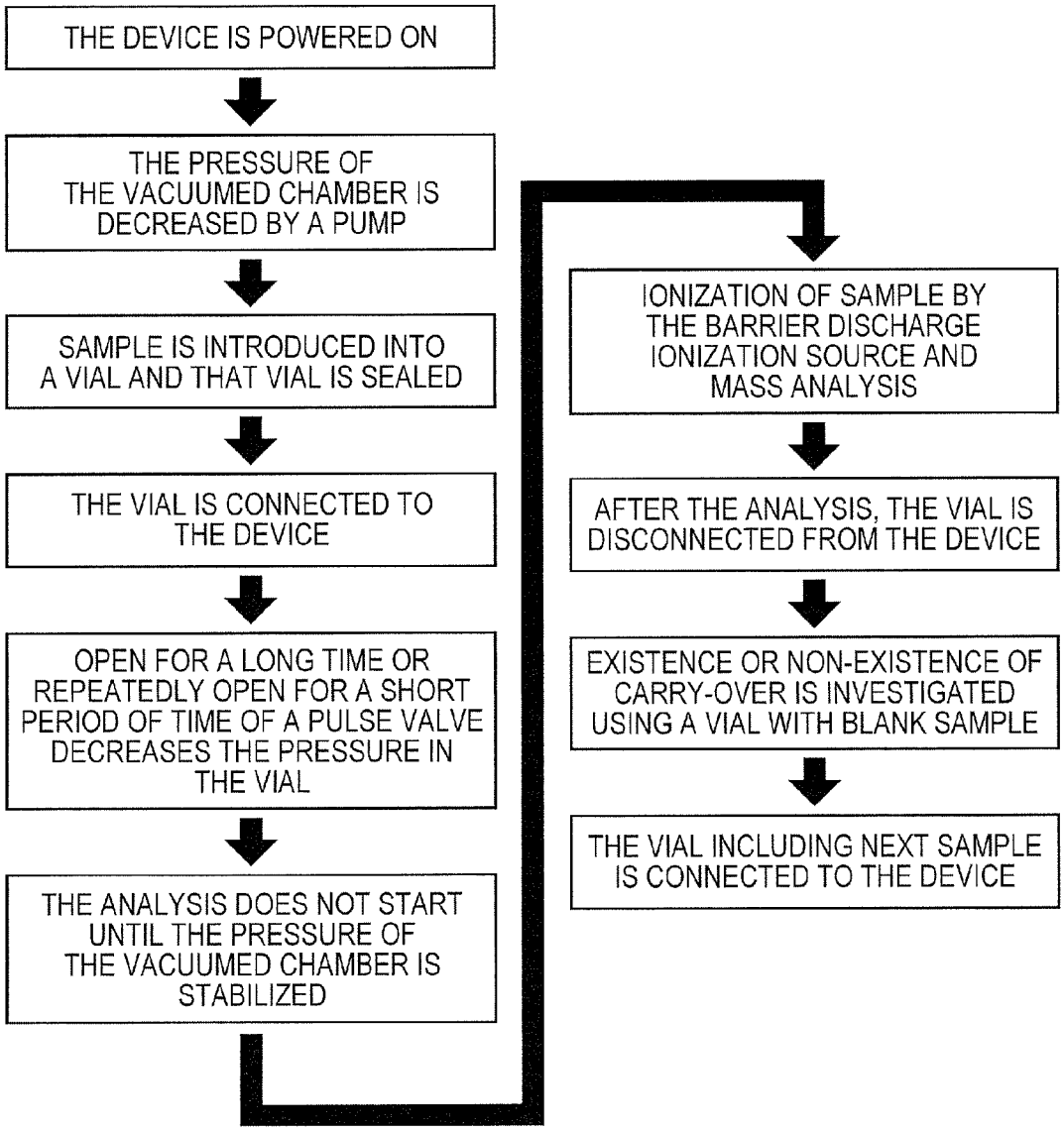
FIG. 11 shows a flow of measurement in the fourth embodiment.

FIG. 10 is a configurational view showing an embodiment of the mass spectrometer according to the invention. The pressure condition for the plasma 10 and the output voltage of the power source 51 are identical with those in the first embodiment. Different from the first and second embodiments, a pump is not connected to a vial bottle 1. FIG. 11 shows a flow of measurement of the fourth embodiment. The procedures from injection to close sealing of the sample in a vial bottle 1 are identical with those in the first and second embodiments. In the fourth embodiment, the vial bottle 1 is not depressurized by the pump but set to the device with the inner pressure being at the atmospheric pressure as it is. Then, the pressure of the vial bottle 1 is decreased from the side of the vacuum chamber 5 by keeping the pulse valve 30 to open continuously for a predetermined time, or opening and closing the valve pulsatively over and over. Pressure in the vial bottle 1 can be estimated based on the numerical values on a pressure gage attached to the vacuum chamber 5. The pressure is stabilized constant at the state where the flow rate generated from the sample solution and the exhaust amount of the pump are balanced. Since the flow rate generated from the sample solution depends on the temperature of the solution, the pressure stabilized at a constant level is controlled by the temperature of the solution. After the pressure is settled constant, the power source of the barrier discharge is turned on to start mass spectroscopy.

Compared with the first and second embodiments, since the pump for decreasing the pressure inside of the vial bottle 1 and the sample transfer line are not necessary, the size of the device is decreased. Further, since the step of setting the vial bottle 1 after depressurizing the device is saved, the flow of measurement carried out by a measuring operator per se can be simplified. However, since the pulse valve 30 is opened and closed in a state of setting the vial bottle 1 at an atmospheric pressure to the device, a headspace gas is be introduced at a great flow rate into the vacuum chamber 5 and may possibly damage the pump. Further, the great amount of gas may possibly contaminate the ionization housing 3.

Fifth Embodiment

Figure 12:
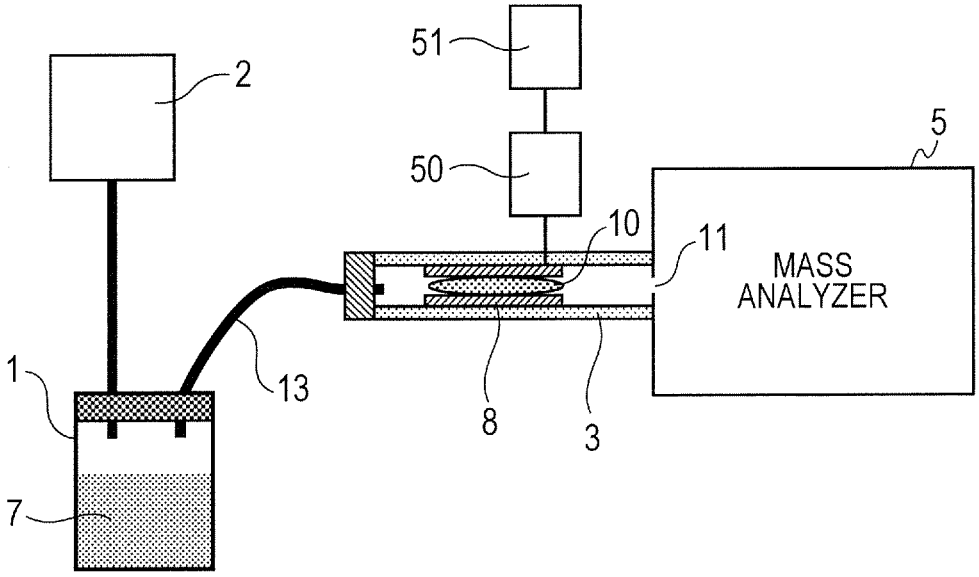
FIG. 12 shows a configurational view for a device of a fifth embodiment.

FIG. 12 is a configurational view showing an embodiment of the mass spectrometer according to the invention. The pressure conditions for the plasma 10 are identical with those of the first embodiment. Different from first to third embodiments, glow discharge is generated not by way of the dielectric substance thereby generating a plasma 10 by arranging two discharge electrodes in the ionization housing 3 and applying a DC voltage between the electrodes. Further, a current limiting resistor 50 is interposed between an electrode and a power source 51 to limit the current thereby moderating discharge. While application of an AC voltage is necessary in a case of discharge by way of the dielectric substance, a DC voltage may be applied in the glow discharge not by way of the dielectric substance, which can simplify the design for the power source. On the other hand, since the electrodes are present inside the ionization housing 3, there may be a possibility of contamination and the robustness is higher in the case of the first embodiment. In this embodiment, the pulse valve 30 as shown in the second embodiment may also be incorporated. Further, the pressure inside of the vial bottle may be decreased from the side of the vacuum chamber 5 without using the pump as shown in the fourth embodiment. The heater 14 for heating the vial bottle 1 shown in the first embodiment is applicable also in this embodiment.

Sixth Embodiment

Figure 13:
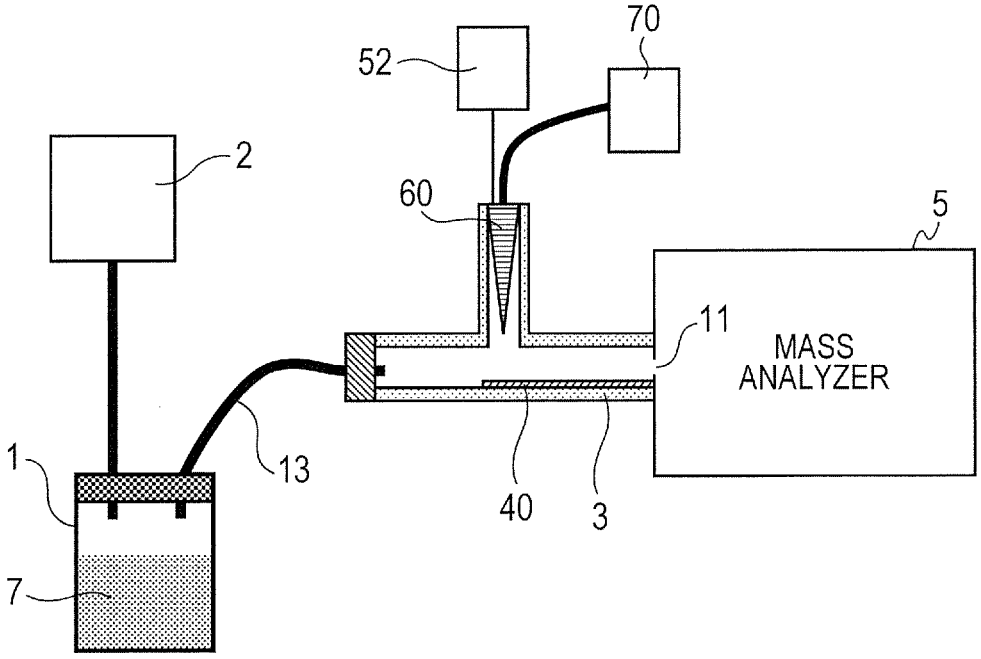
FIG. 13 shows a configurational view for a device of a sixth embodiment.

FIG. 13 is a configurational view showing an embodiment of the mass spectrometer according to the invention. A probe 60 for electrospray ionization is inserted in an ionization housing 3. A potential difference of 1-10 kV is formed between a probe 60 for electrospray ionization and a counter electrode 40 disposed in the ionization housing 3. Charged droplets are generated by jetting out a solution from the probe 60 for electrospray ionization connected with a pump 70 for the delivery of the solution. Molecules in the headspace gas sprayed by a tube 13 collide against the charged droplets to generate ions. Ions are introduced into a vacuum chamber 5 due to the pressure difference between the ionization housing 3 and the vacuum chamber 5. In the electrospray ionization, multiply charged ions tend to be generated more compared with the barrier discharge or glow discharge ionization method. Accordingly, mass spectroscopy for high-mass ions is easy in this method. In this method, when the pressure in the ionization housing 3 is excessively low, the charged droplets cannot be provided with thermal energy from the surrounding gas and the charged droplets can not be split and vaporized to lower the ionization efficiency. Therefore, the pressure in the ionization housing 3 is set so as to keep both the ionization efficiency and the introduction efficiency of ions into the vacuum chamber 5 at high levels. Specifically, the pressure is preferably from 100 to 5,000 Pa.

A pump 70 for supplying a solution for generating charged droplets to the probe 60 is necessary for electrospray ionization, which makes the structure complicate. Further, for stably generating charged droplets, an inert gas such as nitrogen is preferably introduced as an auxiliary gas in a manner concentrical with the jetting port of the probe 60 for electrospray ionization. While the probe 60 for electrospray ionization is situated vertically to the tube 13 in FIG. 13, the positional relation may be controlled so as to maximize the sensitivity.

The heater 14 for heating the vial bottle 1 shown in the first embodiment and the pulse valve 30 shown in the second embodiment are applicable also in this embodiment.

Seventh Embodiment

Figure 14:
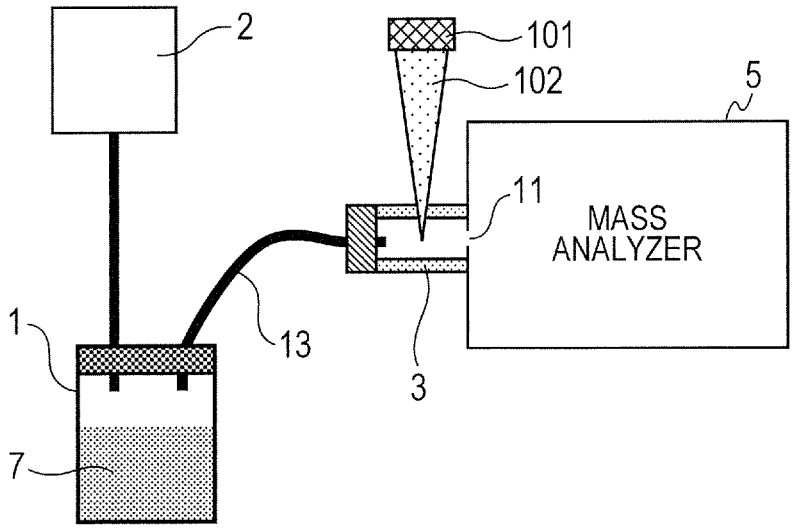
FIG. 14 shows a configurational view for a device of a seventh embodiment.

FIG. 14 is a configurational view showing an embodiment of the mass spectrometer according to the invention. In this embodiment, a laser beam 102 is irradiated from the outside of the ionization housing 3 to ionize the sample by laser ionization. When a laser beam at a wavelength near the absorption wavelength of the sample is used, the ionization efficiency is improved. On the other hand, an optical source 101 or an optical system for the laser beam are necessary, which makes the configurational of the entire device complicate. Further, the irradiation position of the laser beam 102, etc. should be controlled accurately.

The heater 14 for heating the vial bottle 1 shown in the first embodiment and the pulse valve shown in the second embodiment are applicable also in this embodiment.

Eighth Embodiment

Figure 15:
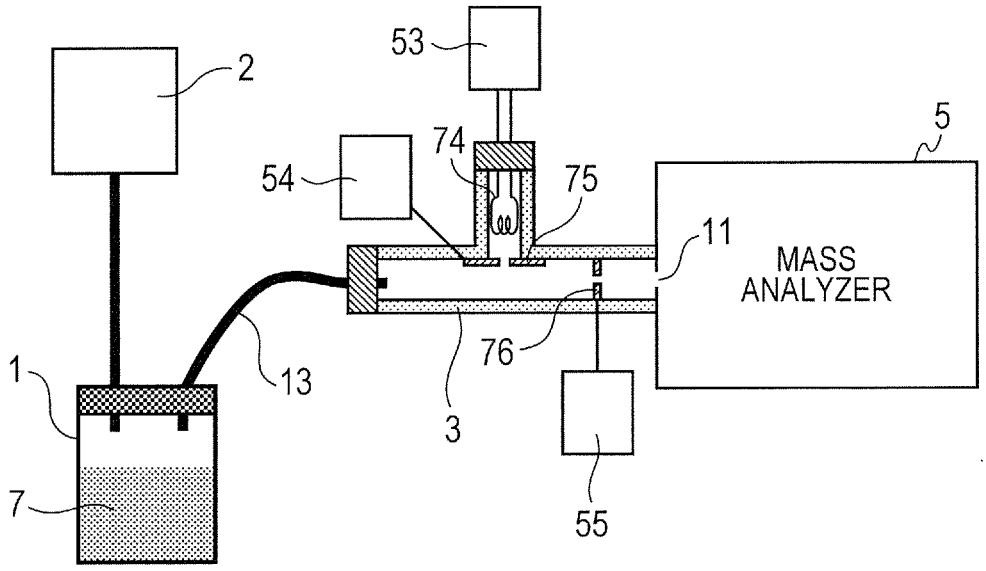
FIG. 15 shows a configurational view for a device of an eighth embodiment.

FIG. 15 is a configurational view showing an embodiment of the mass spectrometer according to the invention. This embodiment uses an electron ionization (EI) method of generating thermal electrons by a metal filament 74, colliding the electrons, against a sample gas, in a state accelerated to 50 to 100 eV by lead electrodes 75 connected to a power source 54 thereby ionizing the sample. The generated ions are transported by an electric field due to an ion acceleration lens 76 connected to a power source 55 to a mass analyzer. Since EI can be attained only by the small-sized DC power source 53 for EI, the device can be easily reduced in the size. On the other hand, molecules tend to undergo fragmentation upon ionization, which makes complicates spectra and make the analysis difficult.

The heater 14 for heating the vial bottle 1 shown in the first embodiment and the pulse valve 30 shown in the second embodiment are applicable also in this embodiment.

What is claimed is:

1. A mass spectrometer comprising:

a sample vessel in which a water solution containing sample molecules is sealed, where at least some of sample is vaporized;

an ionization housing connected to the sample vessel by a first pipeline having a pulse valve connected thereto and to the ionization housing, and having a discharge ionization source of taking in a gas containing vaporized sample molecules and water molecules which are present in the sample vessel and ionizing the sample molecules by ion molecule reaction, the pressure being lower than the pressure inside of the sample vessel, the pulse valve configured to discontinuously introduce the gas into the ionization housing;

a vacuum chamber connected to the ionization housing, said vacuum chamber having a pump coupled thereto, said pump configured to maintain a pressure of the vacuum chamber at 0.1 Pa or lower, and said vacuum chamber having a mass analyzer for analyzing the ionized sample by m/z; and means for decreasing the pressure inside of the sample vessel, wherein the means for decreasing the pressure inside of the sample vessel is connected to a second pipeline in which the other side of the second pipeline is connected to the sample vessel or the first pipeline.

2. The mass spectrometer according to claim 1, wherein the means for decreasing the pressure inside of the sample vessel decreases the pressure inside the sample vessel to 50,000 Pa or lower.

3. The mass spectrometer according to claim 1, wherein the means for decreasing the pressure inside of the sample vessel decreases the pressure inside the sample vessel to 30,000 Pa or lower.

4. The mass spectrometer according to claim 1, wherein the means for decreasing the pressure inside of the sample vessel decreases the pressure inside the sample vessel to 10,000 Pa or lower.

5. The mass spectrometer according to claim 1, comprising means for heating the sample vessel.

6. The mass spectrometer according to claim 1, wherein an on-off mechanism for controlling the introduction of the sample gas is interposed between the sample vessel and the vacuum chamber.

7. The mass spectrometer according to claim 1, wherein the ionization source comprises paired electrodes disposed while putting a portion of the ionization housing formed of a dielectric substance therebetween and a power source, in which a discharge plasma is generated by dielectric barrier discharge generated by the application of a voltage on the electrode pair to thereby generating ions.

8. The mass spectrometer according to claim 1, wherein the ionization source comprises paired electrodes disposed inside the ionization housing and a power source, in which discharge plasma is generated by glow discharge generated by the application of a voltage to the electrode pair, thereby generating ions.

9. A mass analyzing method using a sample vessel in which a water solution containing sample molecules is sealed, where at least some of sample is vaporized;

an ionization housing connected to the sample vessel by a first pipeline having a pulse valve connected thereto and to the ionization housing, and having a discharge ionization source for ionizing the sample molecules by ion molecule reaction, and a vacuum chamber connected to the ionization housing said vacuum chamber having a first pump coupled thereto, said first pump being configured to maintain a pressure of the vacuum chamber at 0.1 Pa or lower, and said vacuum chamber having a mass analyzer for analyzing the ionized sample by m/z and a second pump connected to a second pipeline in which the other side of the second pipeline is connected to the sample vessel or the first pipeline, the method comprising:

decreasing pressure inside of the vacuum chamber;

decreasing the pressure inside of the sample vessel using the second pump;

taking in, discontinuously, a gas containing vaporized sample molecules and water molecules which are present in the sample vessel to the ionization housing via the pulse valve and ionizing the sample molecules; and analyzing the ionized sample in the mass analyzer.

10. The mass analyzing method according to claim 9, comprising:

using the pulse valve for controlling the introduction of the sample interposed between the sample vessel and the vacuum chamber, decreasing the pressure inside of the vacuum chamber in a state where the pulse valve is closed; and decreasing the pressure inside of the sample vessel by switching the pulse valve from a closed state to an open state.

11. A mass spectrometer comprising:

a sample vessel in which a solid or liquid sample is sealed, where at least some of sample is vaporized;

an ionization housing coupled to the sample vessel and having an ionization source of taking in, discontinuously, a gas containing vaporized sample molecules which is present in the sample vessel via a pulse valve coupled to the sample vessel and to the ionization housing and ionizing the same, the pressure being lower than the pressure inside of the sample vessel;

a vacuum chamber coupled to the ionization housing said vacuum chamber having a first pump coupled thereto, said first pump configured to maintain a pressure of the vacuum chamber at 0.1 Pa or lower, and said vacuum chamber having a mass analyzer for analyzing the ionized sample by m/z; and a second pump for decreasing the pressure inside of the sample vessel, wherein the second pump is coupled to one side of a pipeline in which another side of the pipeline is coupled to the sample vessel.

* * * * *